US008471485B2

(12) United States Patent
Richter

(10) Patent No.: US 8,471,485 B2
(45) Date of Patent: Jun. 25, 2013

(54) DIMMER SWITCH ASSEMBLY

(76) Inventor: Edward J. Richter, Flat Rock, MI (US)

( * ) Notice: Subject to any disclaimer, the term of this patent is extended or adjusted under 35 U.S.C. 154(b) by 936 days.

(21) Appl. No.: 12/074,910

(22) Filed: Mar. 7, 2008

(65) Prior Publication Data

US 2008/0224624 A1 Sep. 18, 2008

Related U.S. Application Data

(60) Provisional application No. 60/906,061, filed on Mar. 9, 2007.

(51) Int. Cl.
*H05B 39/04* (2006.01)

(52) U.S. Cl.
USPC ..... 315/209 R; 315/225

(58) Field of Classification Search
USPC ..... 315/209 R, 224, 225, 291, 307, DIG. 4, 315/311
See application file for complete search history.

(56) References Cited

U.S. PATENT DOCUMENTS

| | | | | |
|---|---|---|---|---|
| 5,422,547 | A * | 6/1995 | Brownell | 315/307 |
| 6,114,813 | A * | 9/2000 | Lo et al. | 315/159 |
| 6,597,127 | B2 * | 7/2003 | Takahashi et al. | 315/224 |
| 6,929,388 | B2 * | 8/2005 | Campbell et al. | 362/467 |
| 7,262,554 | B2 * | 8/2007 | Ballenger et al. | 315/56 |
| 7,497,582 | B1 * | 3/2009 | Savicki, Jr. | 362/95 |

* cited by examiner

*Primary Examiner* — Jimmy Vu
(74) *Attorney, Agent, or Firm* — The Weintraub Group, P.L.C.

(57) ABSTRACT

Disclosed herein is a dimmer switch having a broad range of control with a relatively simple circuit having a number of safety features. The circuit employs a triac and diac to selectively conduct an AC power wave. A variable phase shift network having an improved range of control governs the firing angle of the diac. The variable phase shift network includes a first and second series R-C circuits coupled by a bridge resistor.

15 Claims, 3 Drawing Sheets

FIG 1
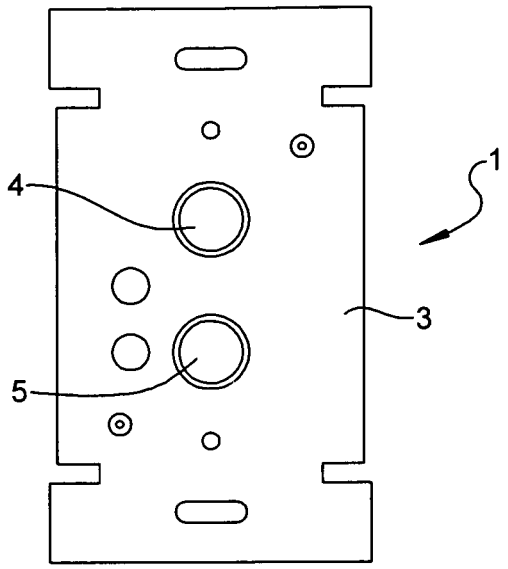
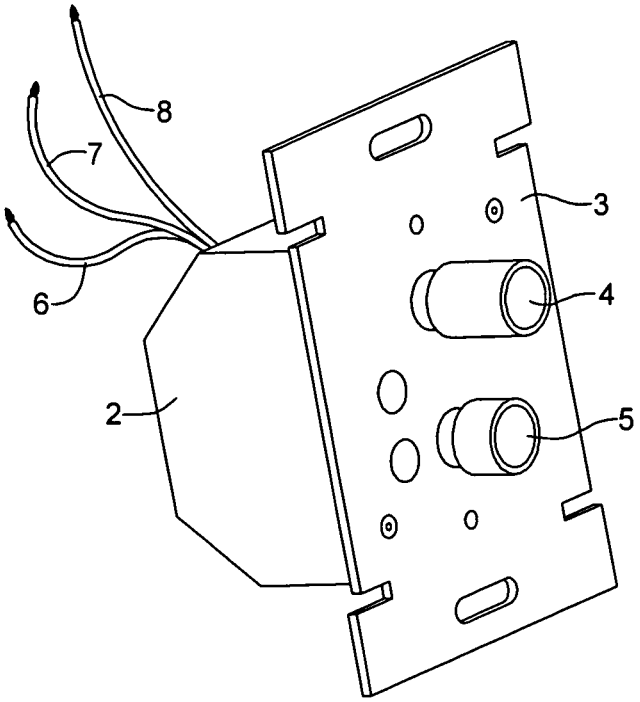
FIG 2

DIMMER SWITCH ASSEMBLY

CROSS-REFERENCE TO RELATED APPLICATION

This application is a completion application of co-pending U.S. Provisional Application No. 60/906,061 filed on Mar. 9, 2007, for "Dimmer Switch Assembly," the entire disclosure of which is hereby incorporated by reference.

BACKGROUND OF THE INVENTION

1. Field of the Invention

The present invention relates to a dimmer switch for controlling the delivery of electrical voltage from a source to load which is especially useful in dimming lamps. More specifically, the invention relates to a dimmer switch having a broader range of control with a relatively simple circuit having a number of safety features.

2. Prior Art

Modern control circuits for dimmer switches commonly use a thyristor, most commonly a triac, to chop the AC power wave from an AC voltage source to the load, such as an incandescent light. A gate controls current flow through the triac, which is signaled to conduct by current flow through the gate. The switch that provides current varies depending on design; examples of devices that conduct current to the gate include an integrated circuit (IC) and another thyristor. However a lower cost dimmer switch may be provided by using a thyristor instead of an IC.

However, inductive loads are a concern when using a thyristor to control switching the power wave of from an AC power source. With inductive loads, dV/dt may become too large, and the sudden rise in voltage can cause the device to be triggered when not desired. Some have solved the problem by introducing "soft start" circuits into the dimming network. However, these circuits add cost and complexity to the switch.

Another concern in using a thyristor is that excessive current can cause damage to the thyristor when the thyristor fires and the potentiometer of a phase shift network, which governs the firing angle of the switch, is set too low. This problem is commonly solved by adding a protective resistor in series with the potentiometer. However, the addition of this additional resistor affects the firing angle of the phase shift network.

Thus, it is desirable to provide a simplified dimmer switch having a broad range of control while having desirable safety features.

SUMMARY OF THE INVENTION

The present invention provides a dimmer switch for controlling the illumination level of a light source or light or lamp by controlling the delivery of alternating current electrical voltage from a source to the light source. The dimmer switch comprises a strap mounted to a housing. The strap supports an on/off switch for selectively applying power to the load and an electrical circuit mounted to said strap. The strap may also serve the function of a heat sink for the electrical circuit.

The electrical circuit comprises a switch connected in series with the light for selectively conducting a portion of the AC current from the source to the light. The switch includes a gate for initiating the selective conduction of current from the source to the lamp. A trigger is coupled to the switch gate for causing the switch to conduct current when a trigger limit voltage is exceeded.

A variable phase shift network for adjusting the firing angle of the switch has a first phase shift circuit across the switch, the first phase shift circuit includes a leading capacitor and a first resistor. The variable phase shift network has a second phase shift circuit across the switch. The second phase shift circuit includes a surge protection resistor, a selectively variable resistor and a firing capacitor, the firing capacitor being coupled to the trigger. The variable phase shift network also has a bridge resistor disposed between the first phase shift circuit and the second phase shift circuit. The bridge resistor couples the leading capacitor to the firing capacitor.

A user selectable dimmer control switch is supported by the strap. The dimmer control switch is coupled to the variable resistor for adjusting the resistance of the variable resistor between about zero resistance and full resistance, whereby the firing angle of the switch is adjusted to control the illumination level of the light.

A snubber circuit is connected across said switch for preventing misfiring of the switch.

Further objects, features and advantages of the present invention will become apparent to those skilled in the art from analysis of the following written description, the accompanying drawings and the appended claims.

BRIEF DESCRIPTION OF THE DRAWINGS

FIG. 1 is a front view of the dimmer switch according to the principles of the present invention, revealing the on-off button and dimmer control;

FIG. 2 is a perspective view of the dimmer switch of FIG. 1, revealing a housing and connection wires;

DESCRIPTION OF THE PREFERRED EMBODIMENT

Figure 3:
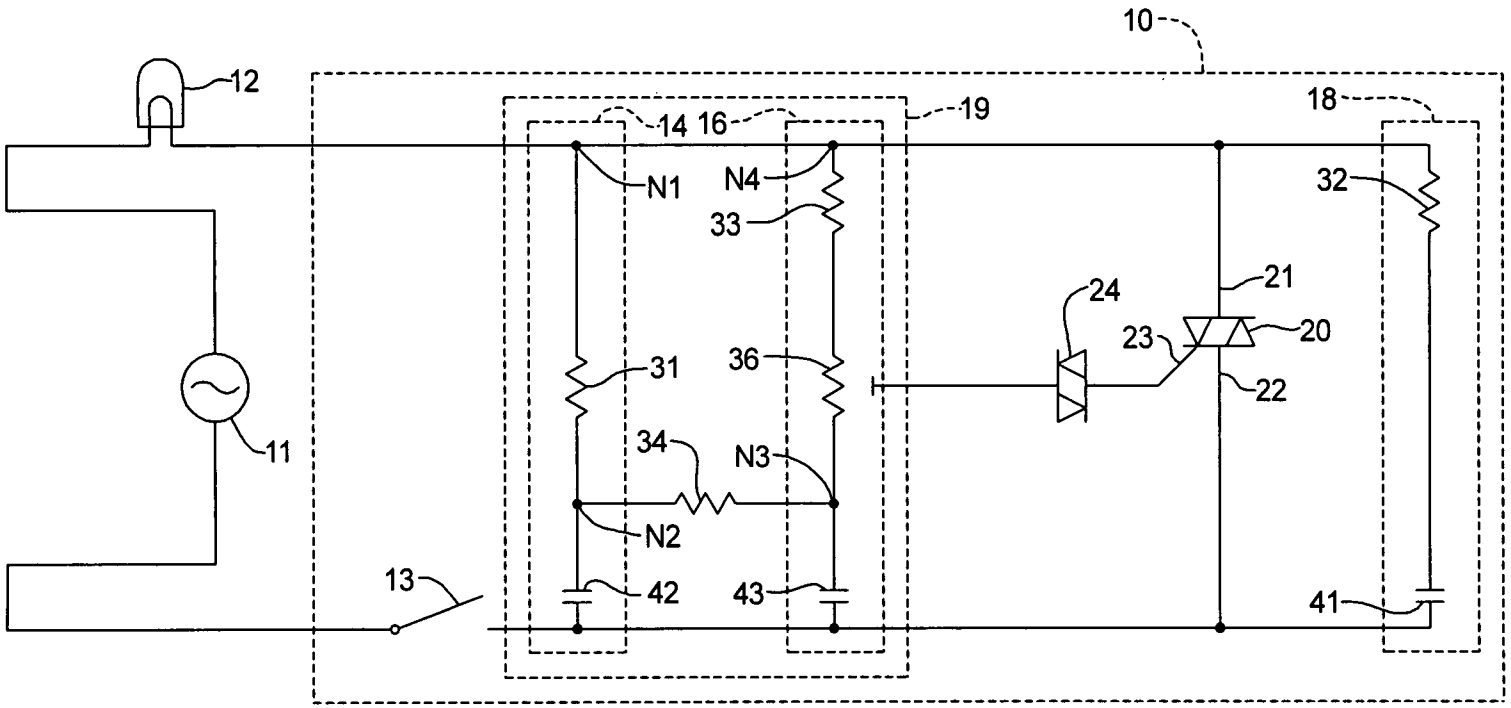
FIG. 3 is a schematic representation of the electrical circuit of the present invention.

Referring now to FIG. 1, a front view of the dimmer switch 1 according to the principles of the present invention for controlling the illumination level of a lamp or light by controlling the delivery of alternating current electrical voltage from a source to the load reveals a strap supporting an on/off switch 4 and dimmer control switch 5. The on/off switch 4 enables a user to selectively conduct power to the load while the dimmer control switch 5 is coupled to a variable resistor, enabling a user to adjust the resistance of the variable resistor, or potentiometer, as it is referred to herein.

Referring now also to FIG. 2, a perspective view of the dimmer switch 1 of FIG. 1 reveals the strap 3 mounted on a housing 2 and connection wires 6,7,8 leading from the housing 2. The housing 2 contains an electrical circuit which is mounted on the strap 3, which also functions as a heat sink for the circuit.

Referring now to FIG. 3, a schematic representation of the electrical circuit 10 of the present invention is shown. The circuit 10 interconnects a power source 11 which is used to power a lamp 12. The load 12 is, preferably, a lamp in which case the circuit 10 is used for dimming. The circuit 10 includes a switch 13 which, in the present embodiment, is a single pole, single throw switch for selectively opening or closing the circuit 10.

A switch 20, which in the present embodiment is a triac Q1, is connected in series with the light 12 and the source 11. The switch 20 includes terminals 21 and 22 and a gate 23. The switch 20 selectively conducts a portion of the AC current from the source 11 to the light 12. When current is provided at the gate 23, terminals 21 and 22 will conduct current to the lamp 12. The application of current at the gate 23 initiates selective conduction of current to the lamp 12. Before firing, the triac Q1 is an open switch, and no voltage is applied across the load 12. After the triac Q1 fires, all of the voltage of the power source 11 is applied across the load 12.

A trigger 24, such as a diac B1, is connected to the gate 23. The trigger 24 provides a current to the gate 23 when a trigger limit voltage is exceeded. The diac B1 prevents any current to the gate 23 until the triggering voltage has reached a certain level in either direction. Therefore, the firing point of the diac B1 is every half cycle. In the preferred embodiment a diac is employed because of characteristics including a consistent firing point and a symmetrical waveform above and below its centerline.

The firing point of the trigger 24 is adjusted by a variable phase shift network 19. Network 19 has a first phase shift circuit 14 connected across switch 20, circuit 14 includes a first resistor 31 such as R1 and a leading capacitor 42 such as C2. The first end of first resistor R1 is connected in series with lead capacitor C2 by a node N2 and the second end is connected to the network 19 at node N1. In the preferred embodiment, R1 has a resistance of 68K ohms and C2 has a capacitance of 104 microfarads. A second phase shift circuit 16 is connected across switch 20; circuit 16 includes a surge protection resistor 33 such as R3, a selectively variable resistor 35 such as potentiometer VR1, and a firing capacitor 43 such as C3. The first end of resistor R3 is connected in series with the second end of variable resistor VR1. The first end of variable resistor VR1 is connected in series with firing capacitor C3 by node N3. Firing capacitor C3 is connected to diac B1. In the preferred embodiment, R3 has a resistance of 1K ohms, VR1 has a resistance of between about 0 and 250K ohms and C3 has a capacitance of 104 microfarads.

The second end of resistor R3 is connected to the network 19 at node N4, as there is no element between N4 and N1, R3 and R1 are connected at their respective second ends. Leading capacitor C2 and firing capacitor C3 are connected at their respective first ends. A bridge resistor R4 connects first resistor R1 at N2 and variable resistor VR1 at N3, as such R4 is disposed between first phase shift circuit 14 and second phase shift circuit 14, coupling leading capacitor C2 to firing capacitor C3 at their respective second ends. As a result, C3 fills through C2, adding to the phase shift of the network 19.

In operation, the selectively variable resistor VR1 affects the charging rate of the firing capacitor C3. C3 charges through R3 and VR1. R3 is present in the event VR1 is set too low to avoid excessive current flow. As VR1 increases, C3 will fill more slowly. Conversely, with a lower VR1 value, C3 will fill more quickly. When VR1 is set to a higher resistance, it takes longer for the capacitor C3 to charge to the firing voltage of the diac B1. As such, the longer it takes for the capacitor C3 to fire, the smaller the conductance phase angle will be, and as such, the triac Q1 will conduct over a smaller portion of the AC power wave form. The position of VR1 will determine the power supplied to the lamp 12 by controlling the charging rate of the capacitor C3.

The present invention employs a double phase shift firing circuit. The double phase shift firing circuit employs the first series R-C circuit 14 that is coupled across the triac Q1, and a second series R-C circuit 16 coupled across the triac Q1. Firing capacitor C3 is coupled to the R-C circuit by means of resistor R4 and to the diac B1 coupled to the gate terminal of the triac by means of potentiometer VR1. Since the leading capacitor C2 is connected to the firing capacitor C3 through the resistor R4, the R4 resistor and C3 capacitor provide a second time constant that gives a greater range of control and improved symmetry, both of which are matters of importance in a dimming switch.

Those skilled in the art will recognize the advantages that the R1, R4, VR1, R3 arrangement provides a divider where the voltage is balanced between nodes N1-N2 and N2-N4. This arrangement enables VR1 to fine tune dimming, resulting in better control.

Additionally, dimmer 1 may include an optional radio frequency interference filter (not shown). A filter is designed to slow high speed switch transients produced by dimmer 1.

The resistor R2 and capacitor C1 in series across the triac Q1 is commonly referred to as a snubber 18. The snubber 18 prevents dV/dt from becoming too large with inductive loads which may trigger the triac Q1. The snubber circuit 18 suppresses the sudden voltage rises appearing across the triac Q1 when the triac Q1 opens due to inductive loads. Snubber 18 also suppresses fast voltage rises across triac Q1 when Q1 turns off, which may cause false (out of sync) triggering of Q1.

Figure 4:
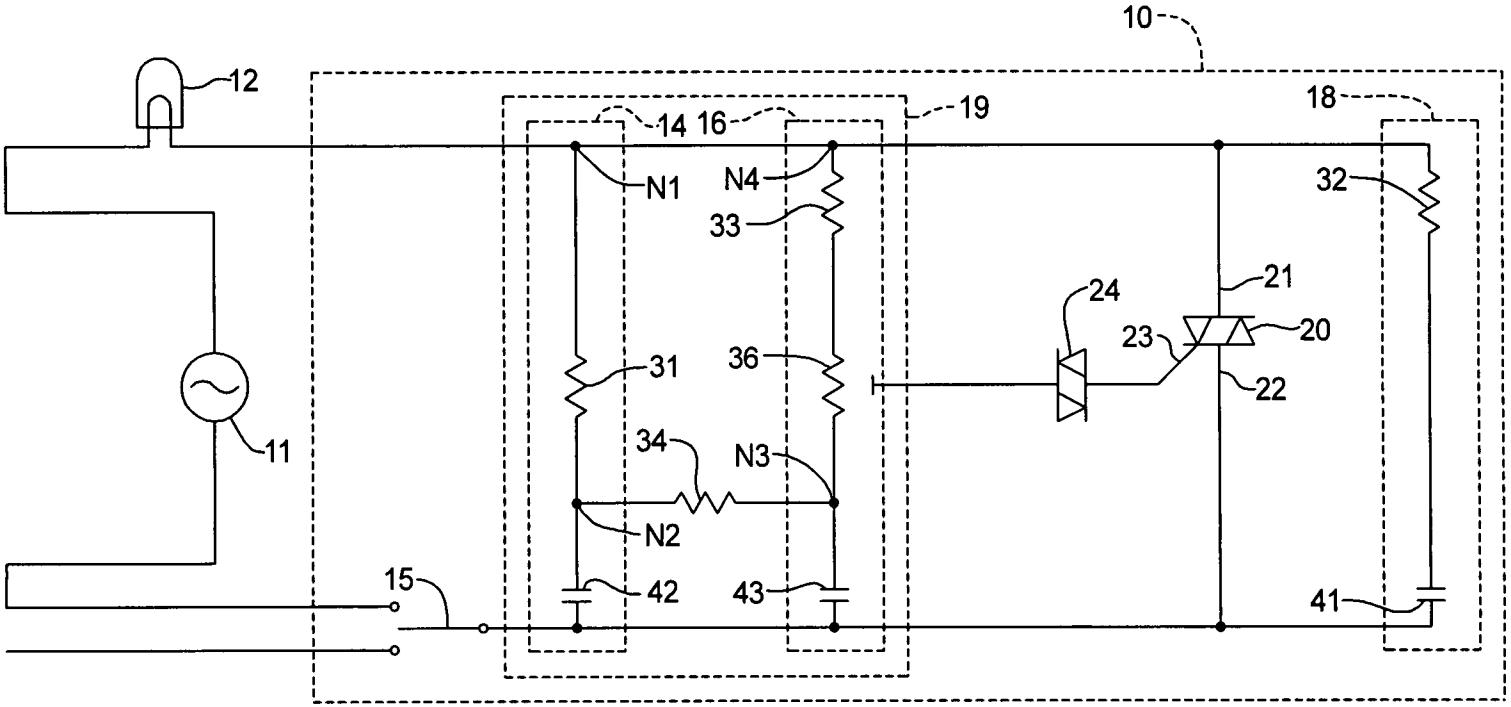
FIG. 4 is an alternate schematic representation of the electrical circuit of the present invention, modified for a three way switch.

Referring now to FIG. 4, an alternate schematic representation of the electrical circuit 10 of the present invention is shown, modified for a three way switch. The circuit 10 includes a single pole double throw switch 15.

The foregoing discussion discloses and describes the preferred structure and control system for the present invention. However, one skilled in the art will readily recognize from such discussion, and from the accompanying drawings and claims, that various changes, modifications and variations can be made therein without departing from the true spirit and fair scope of the invention as defined in the following claims.

Having, thus, described the invention, what is claimed is:

1. A dimmer switch for controlling the illumination level of a light, comprising:

(a) an on/off switch having an "off" position and an "on" position, the on/off switch is in electrical series with the light, the on/off switch including a gate for selective conduction of current from a source to the light;

(b) a trigger coupled to the gate for causing the on/off switch to conduct current when a trigger limit voltage is exceeded;

(c) a variable phase shift network for adjusting the firing angle of the on/off switch, the network comprising a first phase shift circuit and a second phase shift circuit; and (d) a dimmer control switch which is operated independently of the on/off switch and coupled to the variable phase shift network, the dimmer control switch adjusting the illumination level of the light, and operable only when the on/off switch is in the "on" position.

2. The dimmer switch of claim 1 wherein:

(a) the first phase shift circuit includes a leading capacitor and a first resistor;

(b) the second phase shift circuit includes a surge protection resistor, a selectively variable resistor and a firing capacitor, the firing capacitor being coupled to the trigger; and (c) the phase shift network further comprising a bridge resistor disposed between the first phase shift circuit and the second phase shift circuit, the bridge resistor coupling the leading capacitor to the firing capacitor.

3. The dimmer switch of claim 2 wherein:

the dimmer control switch is coupled to the variable resistor for adjusting the resistance of the variable resistor between about zero resistance and full resistance.

4. The dimmer switch of claim 2 which further comprises:

a snubber circuit connected across the dimmer control switch to prevent the misfiring of the on/off switch.

5. The dimmer switch of claim 2 wherein:

the on/off switch is a single pole-single throw switch.

6. The dimmer switch of claim 2 wherein:

the on/off switch is a single pole-double throw switch.

7. The dimmer switch of claim 2 wherein:

the dimmer control switch is a normally open triac Q1 switch connected in series with the light and a power source.

8. The dimmer switch of claim 2 wherein:

the trigger is a diac B1, the firing point of the trigger being every half cycle.

9. A dimmer switch for controlling the illumination level of a light, comprising:

(a) an on/off switch positionable between an "off" position and an "on" position, the on/off switch is in electrical series with a light, the on/off switch including a gate for selective conduction of current from a source to the light;

(b) a trigger coupled to the gate for causing the on/off switch to conduct current when a trigger limit voltage is exceeded;

(c) a variable phase shift network for adjusting the firing angle of the switch, the network comprising: (1) a first phase shift circuit across the switch, the first phase shift circuit including a leading capacitor and a first resistor; (2) a second phase shift circuit across the switch, second phase shift circuit including a surge protection resistor, a selectively variable resistor and a firing capacitor, the firing capacitor being coupled to the trigger; and (3) a bridge resistor disposed between the first phase shift circuit and the second phase shift circuit, the bridge resistor coupling the leading capacitor to the firing capacitor; and a dimmer control switch which is operated independently of the on/off switch and being coupled to the variable phase shift network, the dimmer control switch adjusting the illumination level of the light, and operable only when the on/off switch is in the "on" position.

10. The dimmer switch of claim 9 wherein:

the dimmer control switch is coupled to the variable resistor for adjusting the resistance of the variable resistor between about zero resistance and full resistance.

11. The dimmer switch of claim 10 which further comprises:

a snubber circuit connected across the dimmer control switch to prevent the misfiring of the on/off switch.

12. The dimmer switch of claim 10 wherein:

the on/off switch is a single pole-single throw switch.

13. The dimmer switch of claim 10 wherein:

the on/off switch is a single pole-double throw switch.

14. The dimmer switch of claim 10 wherein:

the dimmer control switch is a normally open triac Q1 switch connected in series with the light and a power source.

15. The dimmer switch of claim 10 wherein:

the trigger is a diac B1, the firing point of the trigger being every half cycle.

* * * * *